US011421704B2

(12) United States Patent
Gruber et al.

(10) Patent No.: US 11,421,704 B2
(45) Date of Patent: Aug. 23, 2022

(54) BLOWER WHEEL

(71) Applicant: ebm-papst Mulfingen GmbH & Co. KG, Mulfingen (DE)

(72) Inventors: Erhard Gruber, Satteldorf (DE); Jens Müller, Künzelsau (DE); Alexander Konzal, Igersheim (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 256 days.

(21) Appl. No.: 16/603,271

(22) PCT Filed: Jun. 5, 2018

(86) PCT No.: PCT/EP2018/064777
§ 371 (c)(1),
(2) Date: Oct. 7, 2019

(87) PCT Pub. No.: WO2019/001912
PCT Pub. Date: Jan. 3, 2019

(65) Prior Publication Data

US 2020/0040904 A1 Feb. 6, 2020

(30) Foreign Application Priority Data

Jun. 30, 2017 (DE) ..... 10 2017 114 679.2

(51) Int. Cl.
*F04D 29/28* (2006.01)
*F04D 29/30* (2006.01)
*F04D 29/66* (2006.01)

(52) U.S. Cl.
CPC ..... *F04D 29/281* (2013.01); *F04D 29/30* (2013.01); *F04D 29/666* (2013.01)

(58) Field of Classification Search
CPC ..... F04D 17/16; F04D 29/30; F04D 29/281; F04D 29/666; F04D 29/282
See application file for complete search history.

(56) References Cited

U.S. PATENT DOCUMENTS 4,335,997 A * 6/1982 Ewing ..... F01D 5/048 416/185
4,958,987 A * 9/1990 Billingsley ..... F04D 29/281 241/46.17

(Continued)

FOREIGN PATENT DOCUMENTS

CH 516743 A 12/1971
CN 1401913 A * 3/2003 ..... F04D 29/30

(Continued)

OTHER PUBLICATIONS

"V. M. Mirsalimov , N. M. Kalantarly, Cracking in a circular disk under mixed boundary conditions, Dec. 27, 2014, Institute of Mathematics and Mechanics, NAS, Baku, Azerbaijan" (Year: 2014).*

(Continued)

*Primary Examiner* — Woody A Lee, Jr.
*Assistant Examiner* — Justin A Pruitt
(74) *Attorney, Agent, or Firm* — Dickinson Wright PLLC

(57) ABSTRACT

A blower wheel having a plurality of blower wheel blades arranged in a blade ring, which are connected to a disc covering the blower wheel blades, at least in sections, on at least one axial side, wherein a connection between the blower wheel blades and the disc determines a transition geometry, which has a rounded curve of a quadratic function when viewed in the cross-section, at least on one side of the blower wheel blades, particularly a side facing radially inward with respect to an axis of rotation of the blower wheel.

19 Claims, 3 Drawing Sheets

(56) References Cited

U.S. PATENT DOCUMENTS

| | | | | | |
|---|---|---|---|---|---|
| 5,061,154 | A * | 10/1991 | Kington | F01D 5/048 | 416/186 R |
| 5,213,473 | A * | 5/1993 | Fiala | F01D 5/048 | 416/183 |
| 6,224,335 | B1 * | 5/2001 | Parisi | F04D 29/162 | 415/206 |
| 6,905,310 | B2 * | 6/2005 | Kawamoto | F04D 29/284 | 416/175 |
| 6,942,460 | B2 * | 9/2005 | Osako | F01D 5/048 | 416/185 |
| 9,039,362 | B2 * | 5/2015 | Fukuda | F04D 25/0613 | 415/206 |
| 9,810,234 | B2 * | 11/2017 | Bahren | F04D 29/30 | |
| 10,267,338 | B2 * | 4/2019 | Takeshita | F04D 19/002 | |
| 10,550,854 | B2 * | 2/2020 | Lorcher | B29C 45/26 | |
| D903,085 | S * | 11/2020 | Gebert | D23/370 | |
| 10,920,786 | B2 * | 2/2021 | Konzal | F04D 29/30 | |
| 10,962,021 | B2 * | 3/2021 | Mazur | F01D 5/141 | |
| 2010/0329871 | A1 * | 12/2010 | Cahill | F04D 29/281 | 416/187 |
| 2012/0045338 | A1 * | 2/2012 | Tadokoro | F04D 29/281 | 416/196 R |

FOREIGN PATENT DOCUMENTS

| | | | | | |
|---|---|---|---|---|---|
| CN | 105673558 | A * | 6/2016 | F04D 29/30 | |
| DE | 29713027 | U1 | 11/1998 | | |
| FR | 1063414 | A | 5/1954 | | |
| JP | 2010151126 | A * | 7/2010 | F04D 29/30 | |
| JP | 5240926 | B2 * | 7/2013 | F04D 29/30 | |
| JP | 2016223403 | A * | 12/2016 | F04D 29/30 | |

OTHER PUBLICATIONS

"Kyungkook Kim, Young Shin Lee, Modal characteristics and fatigue strength of compressor blades, Dec. 10, 2013, Journal of Mechanical Science and Technology" (Year: 2013).*

"Richard G. Budynas, J. Keith Nisbett, Shigley's Mechanical Engineering Design 10th edition, McGraw-Hill" (Year: 2015).*

"Frank P. Bleier, Fan Handbook Selection, Application, and Design, McGraw-Hill" (Year: 1998).*

European Patent Office, Rijswijk, Netherlands, International Search Report of International Application No. PCT/EP2018-064777, dated Sep. 27, 2018, 2 pages.

* cited by examiner

BLOWER WHEEL

CROSS-REFERENCE TO RELATED APPLICATIONS

This application is a 35 U.S.C. § 371 national phase application of International Application No.: PCT/EP2018/064777, filed Jun. 5, 2018, which claims the benefit of priority under 35 U.S.C. § 119 to German Patent Application No.: 10 2017 114 679.2, filed Jun. 30, 2017, the contents of which are incorporated herein by reference in their entirety.

FIELD

The invention relates to a blower wheel which is improved with regard to efficiency and noise characteristics.

BACKGROUND

The statements in this section merely provide background information related to the present disclosure and several definitions for terms used in the present disclosure and may not constitute prior art.

Blower wheels are used, for example, in axial, diagonal, or radial fans for air conveyance. In this process, the achievable efficiency, the rotational speed, and the noise development are substantial technical properties which can always be improved.

A critical area of the blower wheel is the transition between the blower wheel blades and the base and/or cover disc covering them, because there is a significant notch effect and turbulence in the flow here during operation.

Therefore, the object of the present invention is to provide a blower wheel, with which the strength of the transition between the blower wheel blades and the disc covering them is increased and stresses occurring during operation are maximally reduced in order to increase the maximum rotational speed and consequently the efficiency and to reduce noise development.

SUMMARY

This object is achieved by a blower wheel with a plurality of blower wheel blades arranged in a blade ring, which are connected to a disc covering the blower wheel blades, at least in sections, on at least one axial side, wherein a connection between the blower wheel blades and the disc determines a transition geometry, which has a rounded curve of a quadratic function when viewed in the cross-section, at least on one side of the blower wheel blades, particularly a side facing radially inward with respect to an axis of rotation (RA) of the blower wheel.

According to the one aspect of the present disclosure, a blower wheel with a plurality of blower wheel blades arranged in a blade ring is proposed, which are connected to a disc covering the blower wheel blades, at least in sections, on at least one axial side. The connection between the blower wheel blades and the disc determines a transition geometry, which has a rounded curve of a quadratic function when viewed in the cross-section, at least on one side of the blower wheel blades, particularly a side facing radially inward with respect to the axis of rotation of the blower wheel.

The direction specification of the side facing radially inward with respect to an axis of rotation of the blower wheel only results with blower wheel blades curved in the circumferential direction, but not with blower wheel blades specifically curving outward radially. The invention comprises designs of the blower wheel, with which the blower wheel blades are formed so as to curve forward or backward in the circumferential direction.

The rounded curve according to a quadratic function increases the strength of the blower wheel in the critical transition region between the respective blower wheel blades and the adjoining disc, wherein the disc comprises both a base disc as well as additionally or alternatively a cover disc. A larger effect is achieved, however, with the transition geometry between the blower wheel blades and the base disc, i.e. the disc on a side lying opposite the intake side.

With the blower wheel, the quadratic function is preferably determined by the equation $(a \cdot X1^2)+(b \cdot X1 \cdot X2)+X2^2+d=0$, wherein terms X1 and X2 are determined, based on amount, by a length, which corresponds to the respective blower wheel blade thickness, and the values for a, b, d lie in a range where $0.25 \leq a \leq 4$, $-2 \leq b \leq 2$, and $-36 \leq d \leq -0.25$ hold true. Further preferably, the values for a, b, d lie in a range where $0.5 \leq a \leq 2$, $-0.5 \leq b \leq 1$, $-16 \leq d \leq -0.5$ hold true.

By means of the previously described quadratic equation, a curve of the transition geometry is determined, when viewed in the cross-section, which reduces the maximum wall shear stresses occurring during operation in the transition region between the disc and the blower wheel blades by more than 30%. The maximum operational rotational speed can be increased by more than 7% as compared to conventional blower wheels not having the correspondingly rounded contour in the transition region. Furthermore, the transition geometry according to the invention leads to equalization of the flow at the transition between the blower wheel blades and the disc and consequently to reduced turbulence. Among other things, the noise level generated during operation is reduced and the efficiency is improved.

Mathematical term X1 is preferably determined by a unit vector, which extends in the direction of the disc in the extension of an inner wall, facing radially inward with respect to the axis of rotation, of the respective blower wheel blade and has its zero point, based on the amount, at the start of the transition geometry.

Mathematical term X2 is preferably determined by a unit vector, which extends in the direction of the respective blower wheel blade in the extension of a surface, facing axially inward, of the disc and has its zero point, based on the amount, at the start of the transition geometry.

The two unit vectors X1 and X2 are accordingly aligned facing one another and form a point of intersection in their imaginary extensions.

Preferably, a range of ±0.25 is defined, in a tolerance range, for the curve of the transition geometry of X1 and X2.

The transition geometry may be provided on one side at the blower wheel blades; in an alternative design however, it may be provided on two sides, i.e. between the respective blower wheel blades and the disc both on the side of the blower wheel blades facing radially inward with respect to the axis of rotation and on an opposite side facing radially outward. With blower wheel blades specifically curving radially outward, the transition geometry may likewise be provided on both sides.

In a further embodiment of the blower wheel, it is provided that the disc is formed axially pulled in, in the region of the transition geometry, locally restricted in the direction of the blower wheel blade, and determines a recess on a side opposite the blower wheel blade, when viewed in the cross-section. The recess in the disc in this case preferably extends along the full extension of the blower wheel blade and is formed by the shaping of the transition geometry on the disc. The provision of the recesses means that an undesirable accumulation of material is avoided during the creation of the rounded curve of the transition geometry.

In addition, a design of the blower wheel is advantageous from an optimized flow perspective, in which the transition geometry extends over the entire chord length of the respective blower wheel blades.

BRIEF DESCRIPTION OF THE DRAWINGS

Other advantageous further embodiments of the invention are characterized in the dependent claims and/or are shown in more detail in the following by means of the figures, along with the description of the preferred embodiment of the invention with reference to the figures, in which:

The drawings are provided herewith for purely illustrative purposes and are not intended to limit the scope of the present invention. Equivalent reference numerals indicate the same parts in all views.

DETAILED DESCRIPTION

Figure 1:
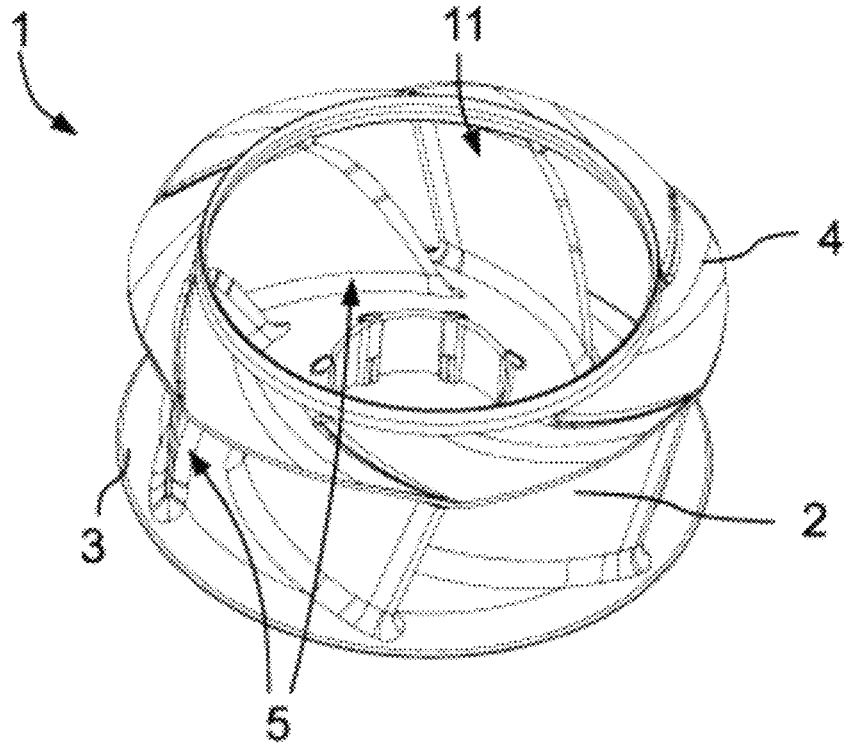
FIG. 1 is a perspective view of an exemplary embodiment of a blower wheel.

The following description is merely exemplary in nature and is in no way intended to limit the present disclosure or its application or uses. It should be understood that throughout the description, corresponding reference numerals indicate like or corresponding parts and features.

Figure 2:
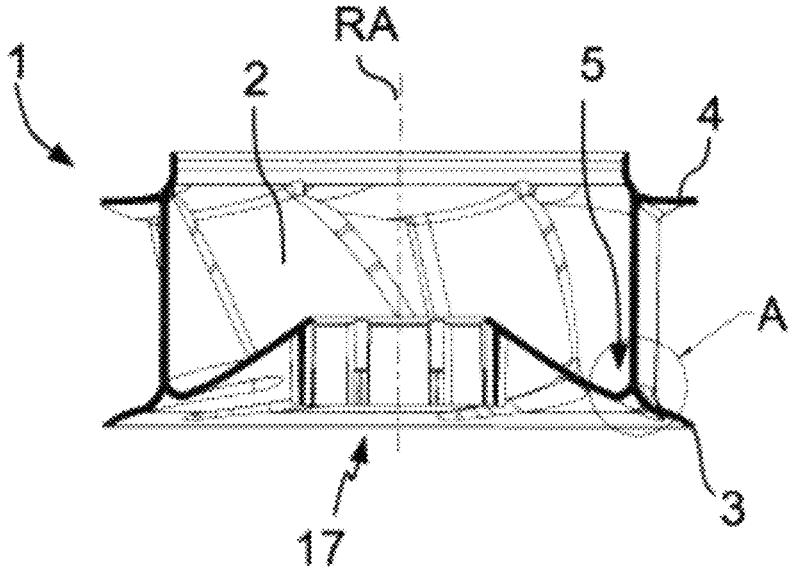
FIG. 2 is a side sectional view of the blower wheel from FIG. 1.
Figure 3:
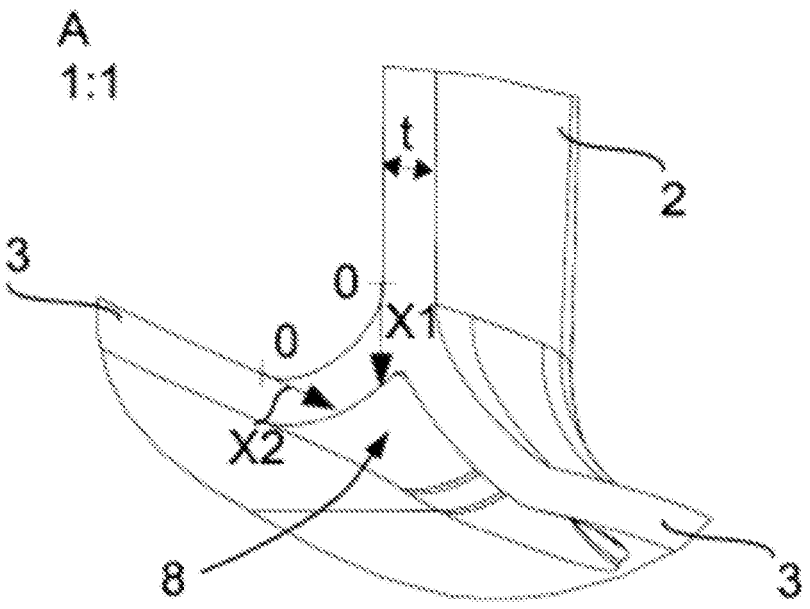
FIG. 3 is a detailed view A from FIG. 2.

FIGS. 1 to 3 show an exemplary embodiment of a blower wheel 1, designed as a radial blower wheel, having a plurality of blower wheel blades 2 arranged in a blade ring and curved in the circumferential direction, which are connected to a cover disc 4 on the intake side and connected to a base disc 3 on the side axially opposite. The blower wheel 1 shown suctions air axially via the intake opening 11 and blows it out radially via channels formed between the blower wheel blades 2. The base disc 3 covers the lower axial front sides of the blower wheel blades 2 completely. In the region of the cover disc 4, the blower wheel blades 2 protrude radially inward via an inner edge of the cover disc 4 such that the upper axial front sides of the blower wheel blades 2 are only covered in sections. In the region of the base disc 3, the blower wheel 1 has a hub 17 for attachment to a drive.

The connection between the blower wheel blades 2 and the base disc 3 determines a specially defined transition geometry 5, which has a rounded curve of a quadratic function when viewed in the cross-section, on a side facing radially inward with respect to the axis of rotation RA of the blower wheel 1. The side facing radially outward away from the axis of rotation RA of the blower wheel 1 also has a rounded curve, when viewed in the cross-section, which is not, however, identical to the transition geometry 5. The transition geometry 5 with the blower wheel 1 extends over the entire chord length of the blower wheel blades 2 along the base disc 3.

The quadratic function of the rounded curve in the exemplary embodiment shown is defined by the equation:

$$(1.06 \cdot X1^2)+(0.09 \cdot X1 \cdot X2)+X2^2+(-9)=0,$$

wherein X1 and X2 correspond to the respective blower wheel blade thickness t (X1=t, X2=t). Term X1 is determined by the unit vector, which extends in the direction of the base disc 3 in the extension of an inner wall facing radially inward with respect to the axis of rotation RA of the respective blower wheel blade 2. Term X2 is determined by the unit vector, which extends in the direction of the respective blower wheel blade 2 in the extension of the surface facing axially inward of the base disc 3. The zero points 0 of the two vectors lie precisely at the start of the transition geometry 5 with respect to the blower wheel blades 2 and/or the base disc 3, as shown in the detailed view in FIG. 3.

As shown well in FIGS. 2 and 3, the base disc 3 is formed axially pulled in, in the region of the transition geometry 5 in the direction of the individual blower wheel blades 2 and determines, when viewed in the cross-section according to FIG. 3, the recess 8 on the lower side opposite the blower wheel blade 2. In doing so, the recesses 8 have a substantially triangular cross-sectional shape and extend over the entire length of the respective blower wheel blades 2.

Figure 4:
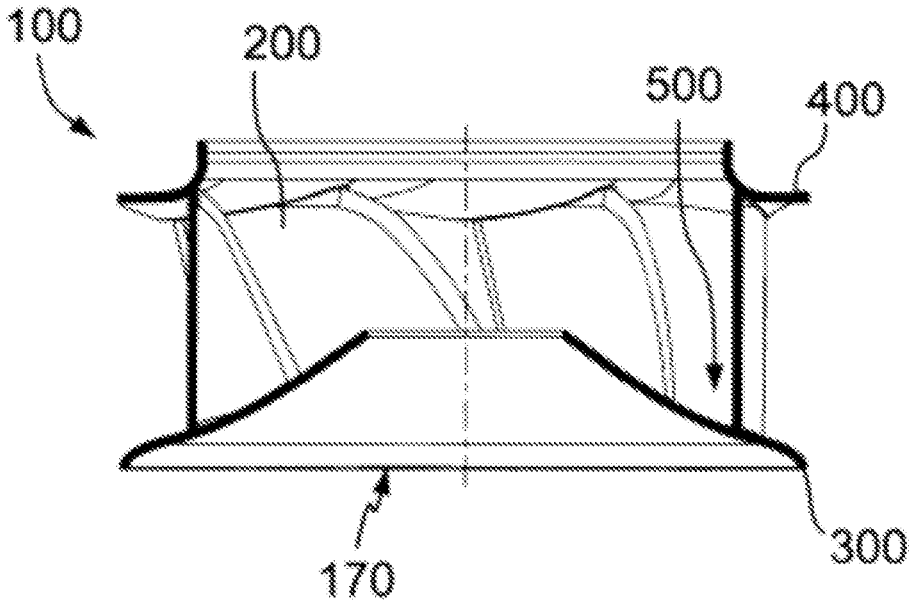
Figure 4 (Prior Art)
FIG. 4 is a side sectional view of a blower wheel according to conventional art.

FIG. 4 shows a blower wheel 100 according to the prior art, which is intended as a comparison blower wheel for determining the previously described improvements recorded with measurement technology. From an optimized flow perspective, it is constructed identical to the blower wheel according to FIG. 1, with blower wheel blades 200, a covered disc 400, a base disc 300, and a hub 170; however, the transition geometry 500 is without a rounded curve of a quadratic function as is usual, but instead is formed in a thrusting manner.

Figure 5:
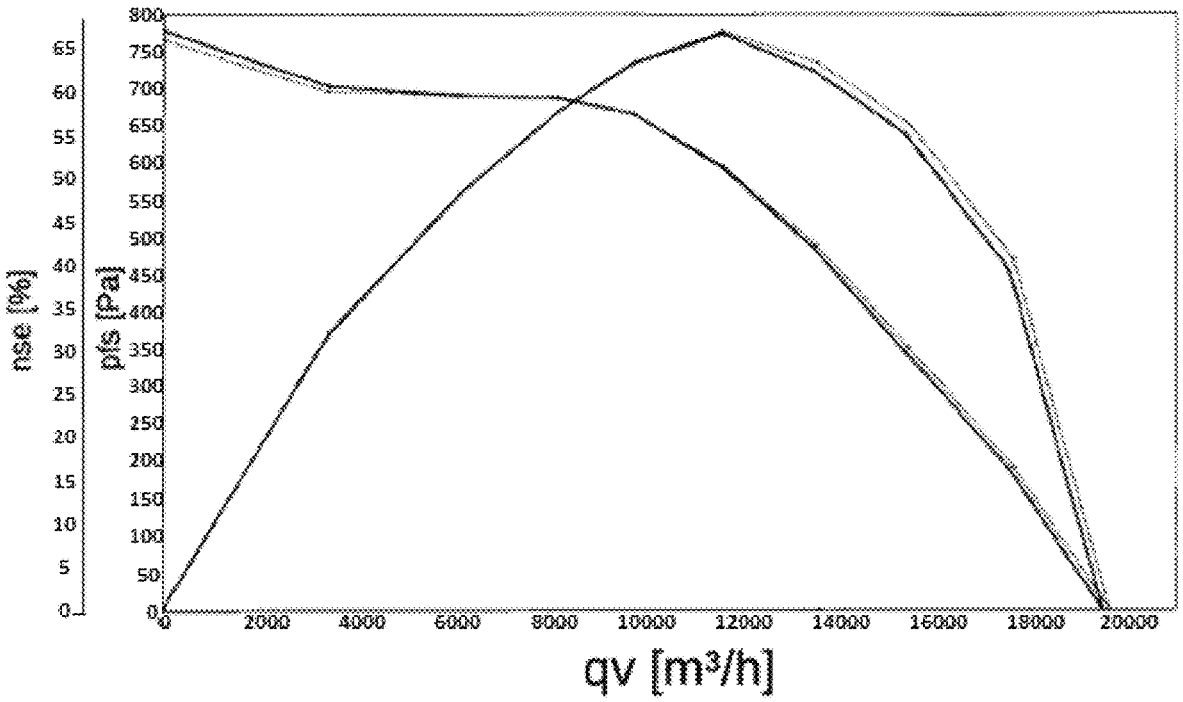
FIG. 5 is a diagram showing the improved efficiency.

FIG. 5 shows a diagram with characteristic curves, measured with an identical test setup, regarding the pressure gradient psf [Pa] and the efficiency nse [%] at different volumetric flows qv [$m^3$/h] of the blower wheel 1 according to FIG. 1 and the same blower wheel 100 without the transition geometry 5 according to FIG. 4, wherein the dotted characteristic curves characterize the blower wheel 1 according to FIG. 1 and the continuous characteristic curves characterize the blower wheel 100 according to FIG. 4 without the transition geometry 5. The advantageous effect of increased spray efficiency with a volumetric flow starting at about 11500 $m^3$/h and up, i.e. in the highly relevant operating area, can be clearly seen.

Figure 6:
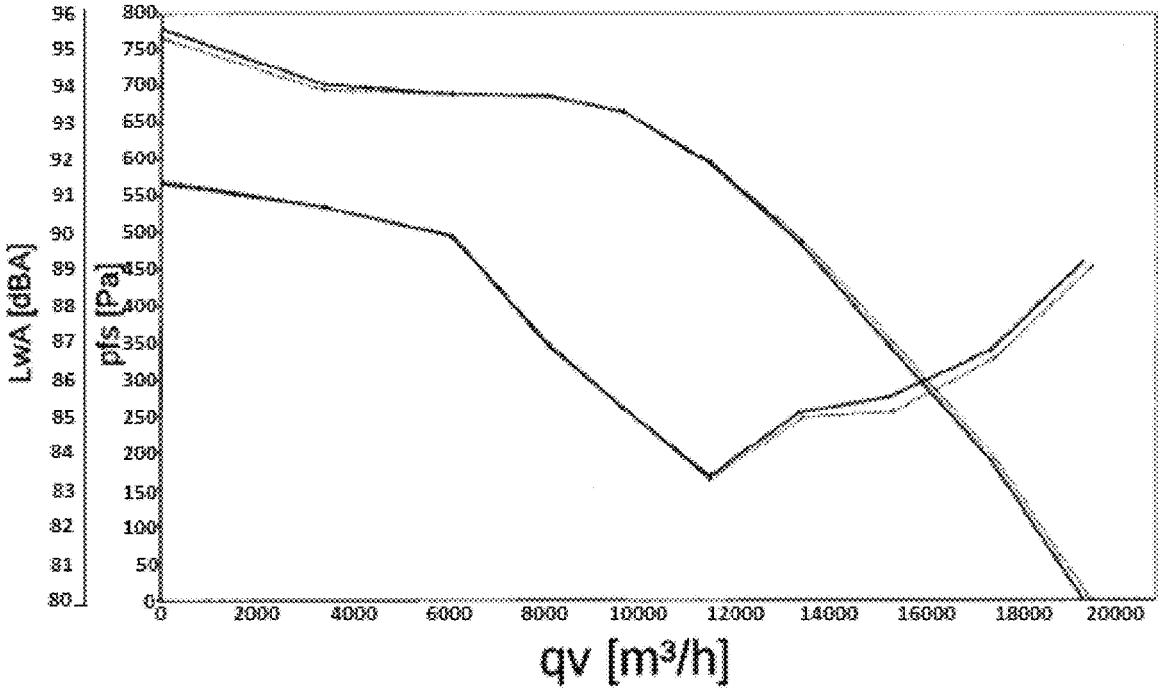
FIG. 6 is a diagram showing the reduced noise development.

In addition to the again shown efficiency nse [%], FIG. 6 additionally shows the measured reduction in the noise characteristics LwA [dBA], wherein again the dotted characteristic curves show the blower wheel 1 according to FIG. 1 and the continuous characteristic curves characterize the blower wheel 100 according to FIG. 4 without the transition geometry 5. Particularly in the range of high rotational speeds and a volumetric flow starting at about 12000 $m^3$/h, the noise development is reduced by more than half a decibel sometimes.

Within this specification, embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

While the above description constitutes the preferred embodiments of the present invention, it will be appreciated that the invention is susceptible to modification, variation and change without departing from the proper scope and fair meaning of the accompanying claims.

The invention claimed is:

1. A blower wheel with a plurality of blower wheel blades arranged in a blade ring, which are connected to a disc covering the blower wheel blades, at least in sections, on at least one axial side, wherein a connection between the blower wheel blades and the disc determines a transition geometry, which has a rounded curve of a quadratic function when viewed in the cross-section, at least on one side of the blower wheel blades, this at least one side facing radially inward with respect to an axis of rotation (RA) of the blower wheel;

wherein the disc is axially pulled in, proximate to the transition geometry in the direction of the blower wheel blades, forming a recess on the side opposite the blower wheel blades, when viewed in the cross-section.

2. The blower wheel according to claim 1, wherein the quadratic function is determined by the equation $$(a \cdot X1^2)+(b \cdot X1 \cdot X2)+X2^2+d=0,$$

wherein X1 and X2 are determined by a respective blower wheel blade thickness (t) and the values for a, b, d are determined by $0.25 \leq a \leq 4$, $-2 \leq b \leq 2$, and $-36 \leq d \leq -0.25$.

3. The blower wheel according to claim 2, wherein the values for a, b, d are determined by $0.5 \leq a \leq 2$, $-0.5 \leq b \leq 1$, and $-16 \leq d \leq -0.5$.

4. The blower wheel according to claim 2, wherein X1 is determined by a unit vector, which extends in the direction of the disc in the extension of an inner wall, facing radially inward with respect to the axis of rotation (RA), of the respective blower wheel blade and has its zero point at the start of the transition geometry.

5. The blower wheel according to claim 2, wherein X2 is determined by a unit vector, which extends in the direction of the respective blower wheel blade in the extension of a surface, facing axially inward, of the disc and has its zero point at the start of the transition geometry.

6. The blower wheel according to claim 2, wherein a tolerance range for the curve of the transition geometry from X1 and X2 is defined to be in a range of ±0.25.

7. The blower wheel according to claim 1, characterized in that the transition geometry between the respective blower wheel blades and the disc is provided on both sides of the blower wheel blades.

8. The blower wheel according to claim 1, wherein the transition geometry between the respective blower wheel blades and the disc is provided both on the side of the blower wheel blades facing radially inward with respect to the axis of rotation (RA) and on an opposite side facing radially outward.

9. The blower wheel according to claim 1, wherein the disc is formed as a base disc or cover disc.

10. The blower wheel to claim 1, characterized in that the blower wheel blades are formed extending in a curve in the circumferential direction.

11. The blower wheel according to claim 1, wherein the transition geometry extends over the entire chord length of the respective blower wheel blade.

12. The blower wheel according to claim 3, wherein X1 is determined by a unit vector, which extends in the direction of the disc in the extension of an inner wall, facing radially inward with respect to the axis of rotation (RA), of the respective blower wheel blade and has its zero point at the start of the transition geometry.

13. The blower wheel according to claim 3, wherein X2 is determined by a unit vector, which extends in the direction of the respective blower wheel blade in the extension of a surface, facing axially inward, of the disc and has its zero point at the start of the transition geometry.

14. The blower wheel according to claim 4, wherein X2 is determined by a unit vector, which extends in the direction of the respective blower wheel blade in the extension of a surface, facing axially inward, of the disc and has its zero point at the start of the transition geometry.

15. The blower wheel according to claim 14, wherein a tolerance range for the curve of the transition geometry from X1 and X2 is defined in a range of ±0.25.

16. The blower wheel according to claim 15, wherein the transition geometry between the respective blower wheel blades and the disc is provided on both sides of the blower wheel blades.

17. The blower wheel according to claim 15, wherein the transition geometry between the respective blower wheel blades and the disc is provided both on the side of the blower wheel blades facing radially inward with respect to the axis of rotation (RA) and on an opposite side facing radially outward.

18. The blower wheel according to claim 17, wherein the disc is axially pulled in, proximate to the transition geometry in the direction of the blower wheel blades, forming a recess on the side opposite the blower wheel blades, when viewed in the cross-section.

19. The blower wheel according to claim 18, wherein the blower wheel blades are formed extending in a curve in the circumferential direction.

* * * * *